US005756947A

United States Patent [19]

Trimble, Jr. et al.

[11] Patent Number: 5,756,947

[45] Date of Patent: May 26, 1998

[54] IGNITION SWITCH

[75] Inventors: Peter J. Trimble, Jr., Twinsburg; Bryan A. Pittman, Atwater, both of Ohio

[73] Assignee: Delta Systems, Inc., Streetsboro, Ohio

[21] Appl. No.: 727,969

[22] Filed: Oct. 9, 1996

[51] Int. Cl.[6] ..... H01H 21/62

[52] U.S. Cl. ..... 200/11 C; 200/11 R; 200/43.08

[58] Field of Search ..... 200/11 C, 11 R, 200/43.08, 43.03, 43.04, 43.09, 46.11, 4, 61.54, 179–180, 11 A, 11 J

[56] References Cited

U.S. PATENT DOCUMENTS

| | | | |
|---|---|---|---|
| 1,663,779 | 3/1928 | Soreng | 200/11 C |
| 2,033,252 | 3/1936 | Parker | 200/11 C |
| 2,695,932 | 11/1954 | Jacobi | 200/11 C |
| 2,715,661 | 8/1955 | Miller | 200/11 C |
| 2,778,891 | 1/1957 | Jacobi | 200/11 C |
| 3,145,700 | 8/1964 | Root | 200/11 C |
| 3,218,401 | 11/1965 | Root | 200/11 C |
| 3,497,644 | 2/1970 | Schink et al. | 200/11 C |
| 3,643,044 | 2/1972 | Batchler | 200/11 C X |
| 3,683,133 | 8/1972 | Heap | 200/11 C |
| 3,819,883 | 6/1974 | Heap | 200/11 C |
| 4,286,126 | 8/1981 | Berginski | 200/11 C |
| 4,295,013 | 10/1981 | Gage et al. | 200/11 C |
| 4,298,776 | 11/1981 | Sondermann | 200/11 C |
| 4,320,266 | 3/1982 | Leiter et al. | 200/11 C |
| 4,975,549 | 12/1990 | Krubsack et al. | 200/11 C |
| 5,252,791 | 10/1993 | Williams | 200/11 C |

*Primary Examiner*—Peter S. Wong
*Assistant Examiner*—K. Shin
*Attorney, Agent, or Firm*—Watts, Hoffmann, Fisher & Heinke Co., LPA

[57] ABSTRACT

An ignition switch is disclosed. The switch includes a housing defining an interior region, a cover affixed to an open back end of the housing and supporting a plurality of electrical terminals. Each terminal includes an end portion extending into the housing interior region. The switch also includes a switch assembly supported by the housing and at least partially disposed within the interior region, the switch assembly being rotatable about an axis of rotation between at least two positions. The switch assembly includes first and second conductive contact plates, the second contact plate being moveable with respect to the first contact plate along the axis of rotation. In at least one of the switch positions, the first contact plate bridges ends of the two terminals and the second contact plate bridges ends of two terminals different that the two terminals bridged by the first contact plate.

23 Claims, 9 Drawing Sheets

IGNITION SWITCH

FIELD OF INVENTION

The present invention relates to a vehicle ignition switch and, more particularly, to an ignition switch having a switch assembly including a plurality of conductive contact plates permitting energization of two independent circuits in a selected switch assembly position.

BACKGROUND OF THE INVENTION

The ignition switch of a vehicle is turned or rotated with a key between two or more positions. In one position, the "off" position, the battery and starter motor circuit are disconnected and a magneto is grounded. In another position, the starting position, a conductive contact plate of the switch, which rotates with the key, bridges a terminal connected to the battery and a terminal connected to the starting motor circuit to energize the starter and start the vehicle. In yet another "run" position of the key, intermediate the off and start position, an accessory set circuit is completed by the contact plate bridging two terminals to provide electrical power to instrument panel lights, a fan, a radio, etc. in the event that an operator wishes to use or check the operation of the accessories without the vehicle running.

In a given ignition switch position, it may be necessary to complete two independent circuits, for example, bridging terminals to energize an accessory set and bridging other terminals to start the vehicle. Thus, the terminals coupled to the battery and the starter will have to be bridged as well as two terminals associated with the accessory set circuit. A total of four terminals will need to be bridged. If one flat conductive contact plate is used to bridge the four terminals and if one terminal end which contacts the contact plate is at a slightly different position or level with respect to contact plate than the other terminal ends, the "shortest" of the terminals is likely to have poor electrical contact with the contact plate. That is, the terminal end of the "shortest" terminal will not be aligned with a plane defined by the three terminal ends of the "longer" terminals. The terminal ends may be at different positions or levels with respect to the contact plate because of terminal manufacturing tolerances, variations in mounting the terminals in a housing, or uneven wear of the terminals.

SUMMARY OF THE INVENTION

An ignition switch of the present invention includes a housing defining an interior region. A switch assembly rotatable with a key is disposed in the housing interior region. A cover is secured to the housing and overlies an open back end of the housing. The cover supports a plurality of terminals having end portions that extend into the housing interior region.

The housing further includes wings extending outwardly from the back end of the housing toward a front end of the housing and abut a back surface of a panel. The front end of the housing includes an outwardly extending plate or bezel which overlies a front section of the panel and cooperates with the wings to hold the switch in place on the panel.

The bezel includes a key receiving opening permitting the key to pass through the housing into a key accepting slot at one end of a switch assembly shaft. The switch assembly rotates along an axis of rotation between a plurality of positions as an operator turns the key.

In addition to the shaft, the switch assembly further includes first and second insulator plates, each plate defining a relatively flat surface including a recess for supporting a conductive contact plate. The first and second insulator plates are coupled to and rotate with the switch assembly shaft. The second insulator plate is supported within a central opening of the first insulator plate and has limited movement with respect to the first insulator plate along the switch assembly axis of rotation. In at least one position of the switch assembly, the first contact plate bridges two terminal ends to complete a first circuit and the second contact plate bridges two terminal ends to complete a second circuit.

The switch assembly shaft includes an outwardly extending disk shaped portion. The shaft is coupled to the first insulator plate so that the first and second contact plates rotate in unison with the shaft and the key. Two concentric compression springs are disposed between a rearward facing side of a disk-shaped portion of the shaft and the first and second insulator plates. Each spring biases a respective one of the insulator plates toward the terminal end portions to provide positive electrical contact between the terminals and the contact plates.

The aforementioned and other aspects of the present invention are described in more detail in the detailed description and accompanying drawings which follow.

DETAILED DESCRIPTION

Figure 1:
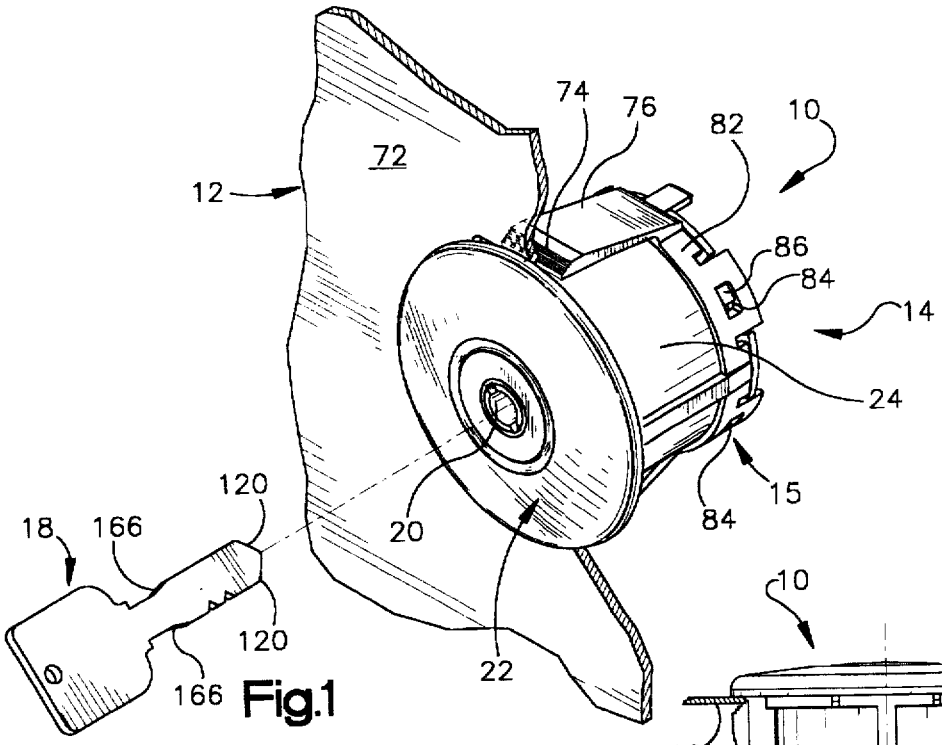
FIG. 1 is a perspective view of an ignition switch of the present invention mounted in a panel of a vehicle, with portions of the panel cut away.
Figure 3:
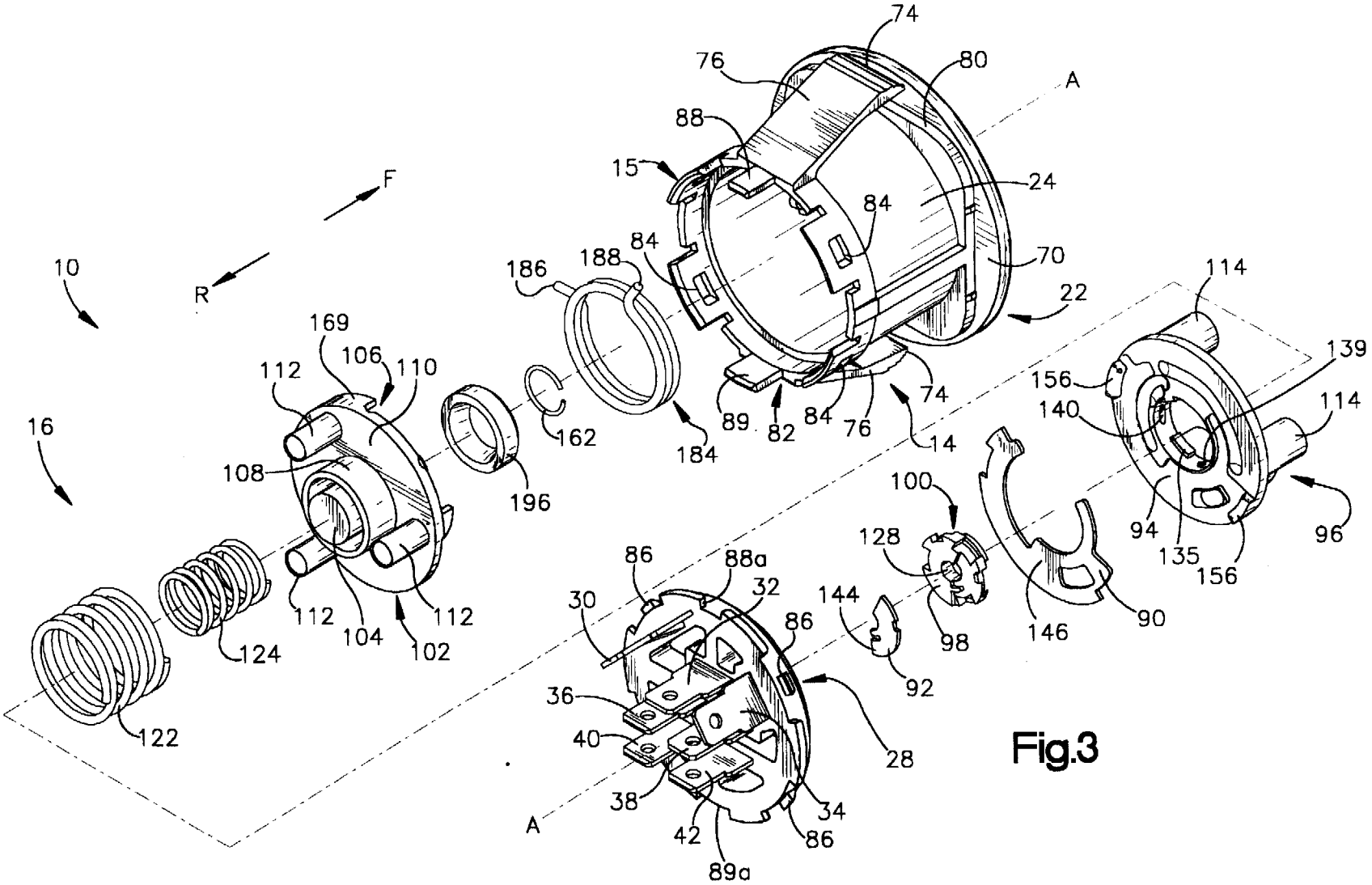
FIG. 3 is an exploded perspective view of the ignition switch of FIG. 1.

The ignition switch of the present invention is shown generally at 10 in FIG. 1. The switch 10 is mounted in an opening in a panel 12 of a vehicle, such as a lawn tractor, and includes a housing 14 defining an interior region and having an open back end 15 (FIG. 3). The interior region of the housing 14 supports a switch assembly 16 which is rotatable between four positions which are approximately 45 degrees apart. The first position (position 1) (shown in FIG. 1), is at 45 degrees counterclockwise with respect to a vertical position. The second position (position 2) is vertical. The third position (position 3) is at 50 degrees clockwise with respect to vertical, while the fourth position (position 4) is at 90 degrees clockwise with respect to vertical. The switch assembly 16 rotates with a key 18 inserted through an opening 20 (FIG. 1) in a face plate or bezel 22 comprising a front side of the housing 14. Extending in a rearward direction from the bezel 22 to the be back end 15 is a cylindrical portion 24. The switch assembly 16 rotates about an aids or rotation labeled A—A in FIGS. 3 and 5. The housing 14 is preferably made of a durable, high impact material with good insulation properties such as polypropylene. The bezel 22 may be configured in any shape desired by the customer and/or required by the design of the panel 12. Additionally, the bezel 22 may be imprinted with indicia such as key position indications and/or customer name, logo, etc.

Figure 2:
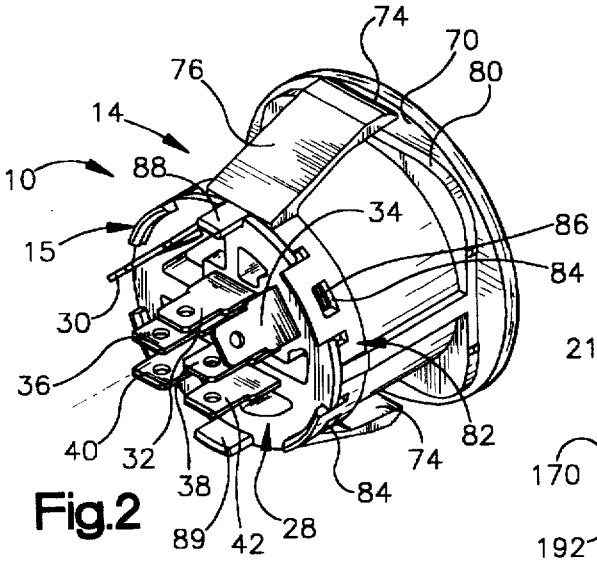
FIG. 2 is a second perspective view of the ignition switch of FIG. 1.
Figure 19:
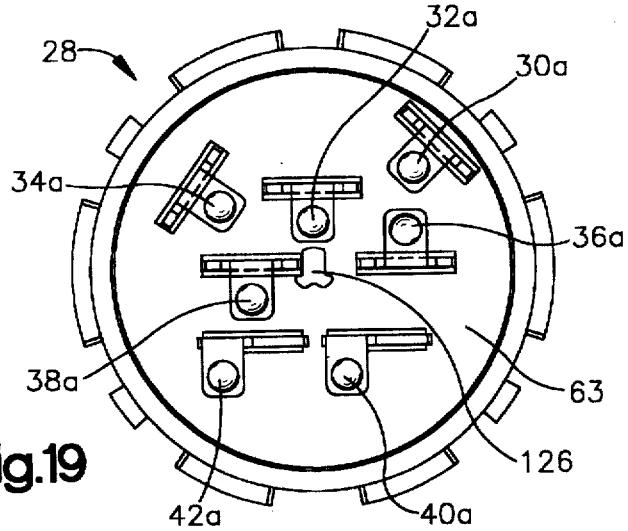
FIG. 19 is the front elevation view of a cover of the ignition switch of FIG. 1.

As can best be seen in FIG. 2, a cover 28, also made of polypropylene, is affixed to the housing 14 and overlies the housing back end 15. The cover 28 supports seven conductive terminals 30, 32, 34 36, 38, 40, 42 made of copper or another highly conductive material. The terminals 30, 32, 34, 36, 38, 40, 42 are press fit through slotted openings in the back cover 28. The terminals 30, 32, 34, 36, 38, 40, 42 are made of copper and have end portions 30*a*, 32*a*, 34*a*, 36*a*, 38*a*, 40*a*, 42*a* (FIG. 19) which extend forward, that is, in a direction labeled F in FIG. 3, into the housing interior region and are bent at right angles so as to be flush against an inner surface 63 of the cover 28. The terminal end portions 30*a*, 32*a*, 34*a*, 36*a*, 38*a*, 40*a*, 42*a* include forward facing spherical raised portions or bumps which provide electrical contact surfaces for the switch assembly 16. The terminals 30, 32, 34, 36, 38, 40, 42 are connected to electrical components and circuits of the vehicle as follows:

| TERMINAL | ELECIRICALLY COUPLED TO |
|---|---|
| 30 | ground |
| 32 | operating lights |

-continued

| TERMINAL | ELECIRICALLY COUPLED TO |
|---|---|
| 34 | accessory set #1 |
| 36 | starter circuit |
| 38 | accessory set #2 |
| 40 | magneto |
| 42 | battery |

At each position of the switch assembly 16, terminals are electrically coupled or bridged by the switch assembly to complete electric circuits as follows:

| Position | Terminals Bridged | Effect |
|---|---|---|
| 1 (Off) | 30–34–40 | Ground out magneto to stop vehicle motor and turn off accessory set #1 |
| 2 (Run 1) | 34–42 | Connect battery and accessory set #1 |
| | 32–38 | Connect accessory set #2 and operating lights to complete circuit |
| 3 (Run 2) | 34–42 | Connect battery and accessory set #1 |
| 4 (Start) | 34–36–42 | Connect battery and starter circuit |
| | | Connect battery and accessory set #1 |

The accessory set #2 and the operating lights are coupled to the battery, coupling terminals 32–38 completes the circuit and energizes the accessory set #2 and the operating lights. Returning to FIGS. 1 and 1A, the switch housing 14 extends through the opening in the panel 12 and is secured to the panel. A back side 70 (FIG. 2) of the bezel 22 abuts a portion of a front surface 72 of the panel 12. A pair of wings 76 extend outwardly and forward from the back end 15 of the housing 14. A distal portion 74 of each wing 76 includes a plurality of steps formed in an outwardly facing surface of the wing distal portion. Depending on a thickness of the panel 12, one of a plurality of steps formed in an outer surface of each wing's distal portion 74 abuts an edge of a back surface 78 of the panel 12 defining the panel opening to secure the switch housing 14 in place. The opening in the panel 12 is generally square with two rectangular-shaped cut outs in opposing sides of the opening.

A stepped portion 80 of the housing 14 just rearward, that is, in a direction labeled R in FIG. 3, of the housing,bezel 22 is sized to snugly fit in the square panel opening. To secure the housing 14 to the panel 12, the wings 76 are aligned with the rectangular-shaped cut outs of the panel opening and the housing back end 15 is pushed through the panel opening. As the housing 14 continues to be pushed through the panel opening, the wings 76 contact the peripheral surface of the panel defining the rectangular-shaped cut outs and are pushed inwardly by the panel peripheral surface. When the housing 14 is fully inserted in the panel opening, the housing bezel 22 abuts the panel front surface 72 and the panel 12 overlies the stepped portion 80 of the housing 14. Further, the wings 76 spring outwardly until a right-angled step of each of the wing distal portions 74 abuts a right-angled edge portion of the panel back surface defining the rectangular-shaped cut outs.

Figure 1A:
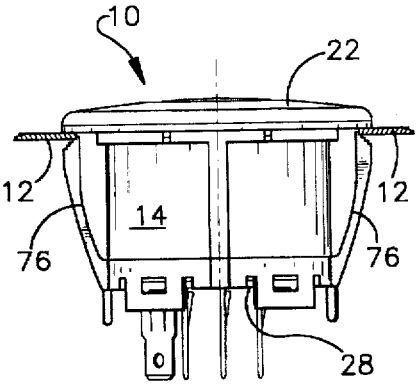
FIG. 1A is a side elevation view of the ignition switch of FIG. 1 mounted in the vehicle panel, with portions of the panel cut away.

The plurality of steps formed in the wing distal portions 74 provide for securement of the switch housing 14 to vehicle panels which may be thicker than the panel 12 shown in FIGS. 1 and 1A. The stepped portion 80 of the housing 14 is seated in the panel opening and, because of the generally square shape of the stepped portion and the opening, is prevented from rotating within the opening.

Figure 6:
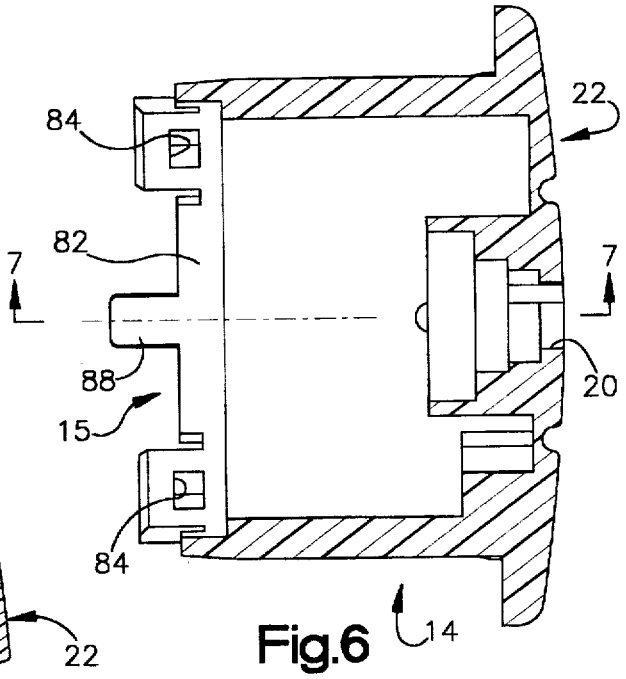
FIG. 6 is a sectional view of a housing of the ignition switch of FIG. 1.
Figure 7:
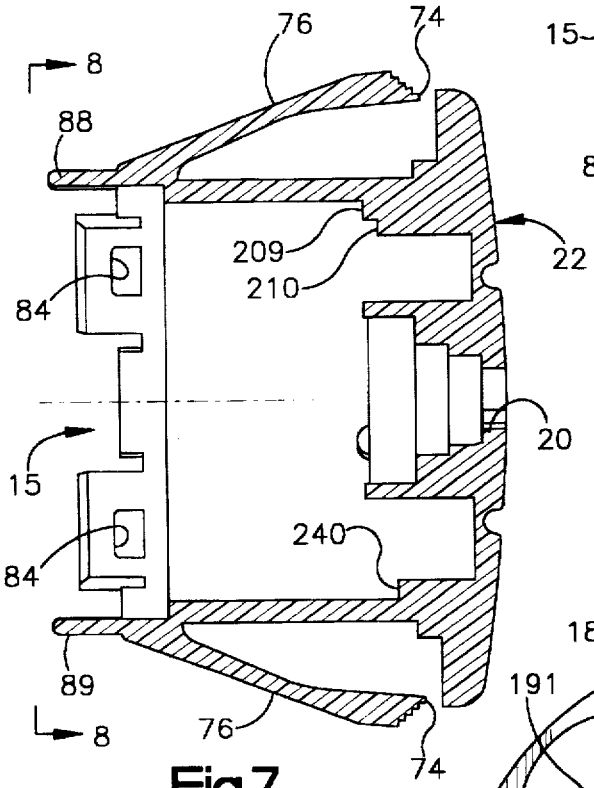
FIG. 7 is a second sectional view of the housing of FIG. 6 as seen from a plane indicated by the line 7—7 in FIG. 6.

During assembly of the switch 10, the cover 28 is snap fit onto a rim 82 of the housing back end 15. The rim 82 includes four cut outs 84 (FIGS. 3, 6 and 7) into which outwardly extending nubs 86 of the cover 28 snap into to secure the cover to the housing 14 and to seal the open housing back end 15. To insure proper alignment of the cover 28 and the housing 14 during assembly of the switch 10, the rim 82 includes a narrow rearward facing upright 88 and a wide rearward facing upright 89 -disposed on opposite sides of the rim. The cover 28 includes a narrow peripheral slot 88*a* and a wide peripheral slot 89*a* which interfit when the cover and the housing 14 are properly aligned. Additionally, the housing rim 82 include a plurality of peripheral slots and the cover 28 includes mating extensions which interfit only when the cover is properly oriented on the housing 14. Proper alignment between the back cover 28 and the housing 14 is necessary because the position of the terminal end portions 30*a*, 32*a*, 34*a*, 36*a*, 38*a*, 40*a*, 42*a* must be suitably oriented within the housing interior region so that the proper terminals are bridged by the switch assembly 16 in each of the four switch positions.

Figure 13:
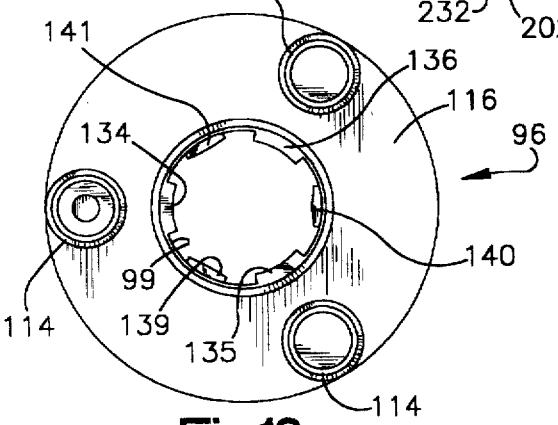
FIG. 13 is a front elevation view of a first insulator plate of the switch assembly of the ignition switch of FIG. 1.
Figure 14:
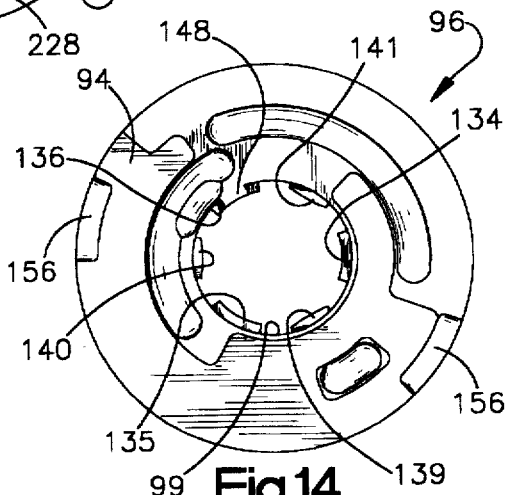
FIG. 14 is a back elevation view of the first insulator plate of FIG. 13.
Figure 15:
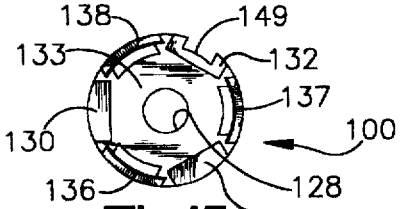
FIG. 15 is a front elevation view of a second insulator plate of the switch assembly.
Figure 16:
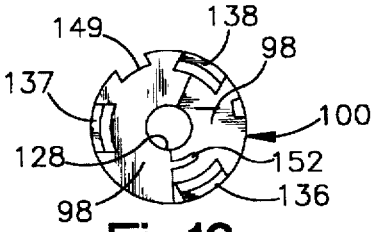
FIG. 16 is a back elevation view of the second insulator plate of FIG. 15.
Figure 17:
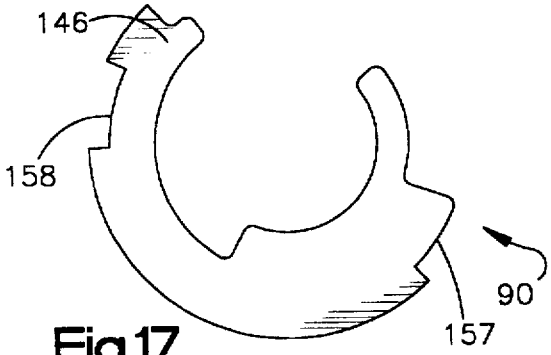
FIG. 17 is a back elevation view of a first conductive contact plate of the switch assembly of the ignition switch of FIG. 1.
Figure 18:
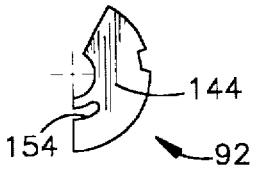
FIG. 18 is a back elevation view of a second conductive contact plate of the switch assembly of the ignition switch of FIG. 1.

The switch assembly 16 includes a first terminal bridging conductive contact plate 90 (FIG. 17) and a second terminal bridging conductive contact plate 92 (FIG. 18). The first and second contact plates 90, 92 are preferably made of copper or another highly conductive material. The first contact plate 90 is supported on a generally flat rearward facing surface 94 of a first insulator plate 96 (FIGS. 13 and 14), while the second contact plate 92 is supported on a generally flat rearward facing surface 98 of a second insulator plate 100 (FIGS. 15 and 16). The insulator plates 96, 100 are preferably fabricated of polypropylene. The rearward facing surfaces 94, 98 of first and second insulator plates 96, 100 include recessed portions configured in a shape of the first and second contact plates 90,. 92, respectively. The surface ,recesses of the surfaces 94, 98 prevent the contact plates 90, 92 from sliding across their respective support surfaces 94, 98 as the switch assembly 16 is rotated between four positions along the axis of rotation A—A.

The second insulator plate 100 "floats" within a central opening 99 (FIG. 14) of the first insulator plate 96 and has limited longitudinal movement (approximately 0.020") with respect to the first insulator plate, that is, movement in a direction along the axis of rotation A—A of the switch assembly 16 or, stated another way, in a direction perpendicular to the first insulator plate rearward facing surface 94. Further, the insulator plate 96 can also pivot slightly with respect to the first insulator plate 96 within the confines of the central opening. That is, a rearward facing surface 133 (FIG. 15) of the second insulator plate 100 does not necessarily have to be parallel to the first insulator plate rearward facing surface 94, rather, the second insulator plate rearward facing surface can be "tipped" or angled with respect to the first insulator plate rearward facing surface.

The "floating" of the second insulator plate 100 with respect to the first insulator plate 96 permits the second contact plate 92 to achieve positive electric contact with the terminal ends it bridges (to be discussed below) in a given switch assembly position even if the first insulator plate in that same switch assembly position is bridging terminal ends which are not congruent with the terminal ends bridged by the second insulator plate. In other words, the "floating" of the second insulator plate 100 permits the completion of two independent circuits (one by the first contact plate 90 and the other by the second contact plate 92) and assures positive electric contact between the first contact plate and its respective bridged terminal ends and positive electric contact between the second contact plate and its respective bridged terminal ends even if the terminal ends are not all congruent, that is, do not have distal portions falling on a common plane.

As the switch assembly 16 rotates, so to do the first and second insulator plates 96, 100 and the first and second contact plates 90, 92. The contact plates 90, 92 are configured to bridge desired terminals ends in each of the four switch assembly positions. The first and second contact plates 90, 92 bridge the following terminals 30, 32, 34, 36, 38, 40, 42 in each of the four switch assembly positions.

Figure 20:
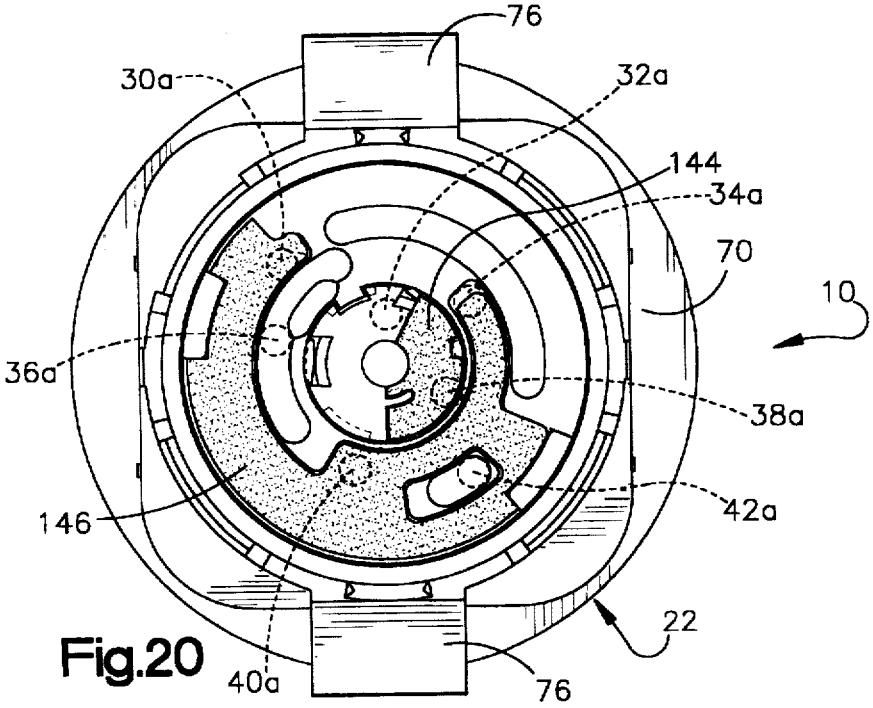
FIG. 20 is a back elevation view of the ignition switch of FIG. 1 with the cover removed and the switch assembly in a first or off position.
Figure 21:
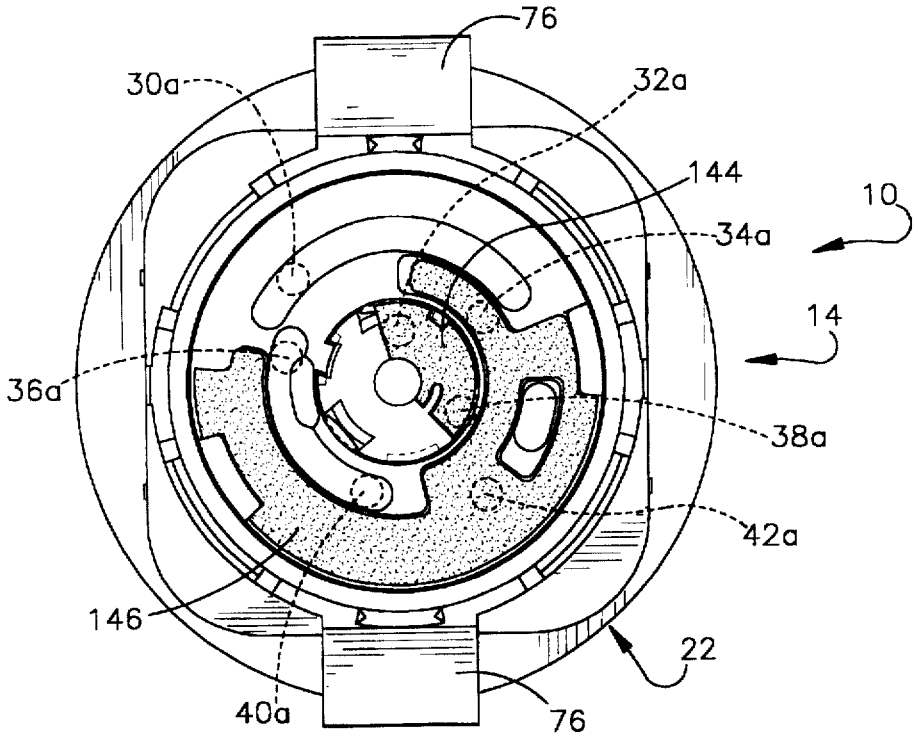
FIG. 21 is a back elevation view of a second or run position.
Figure 22:
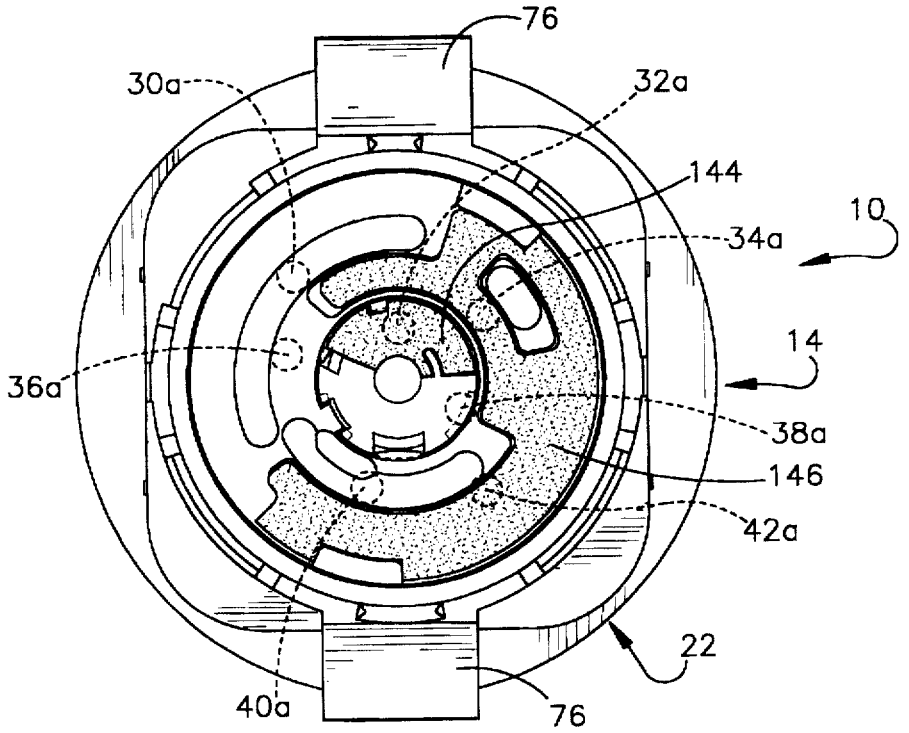
FIG. 22 is a back elevation view of a third or run position.
Figure 23:
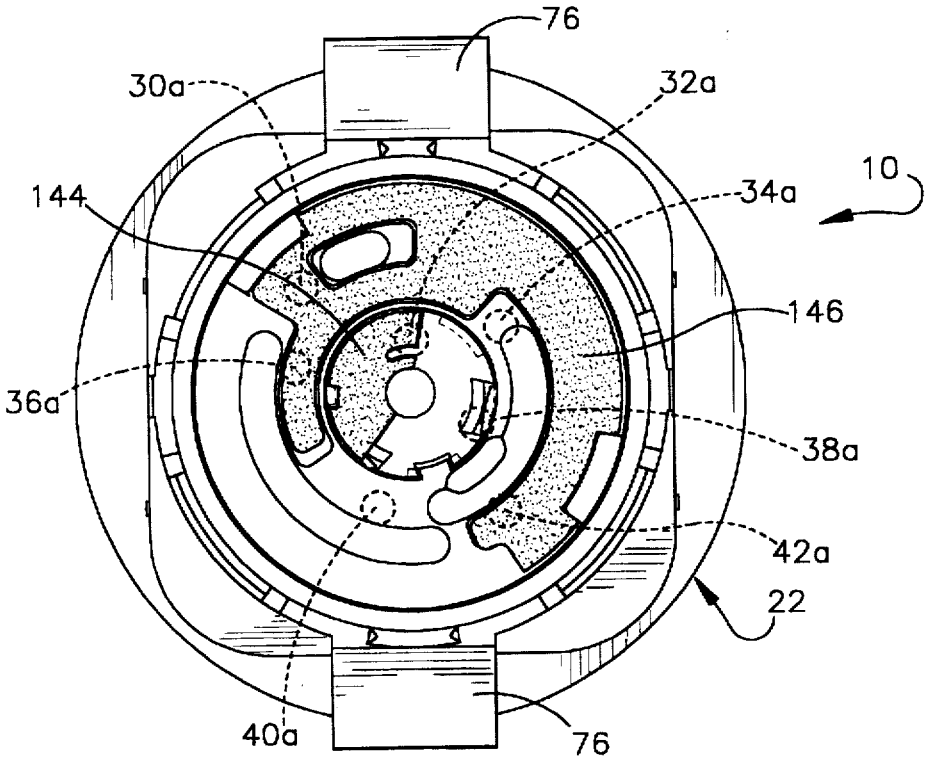
FIG. 23 is a back elevation view of a fourth or momentary start position.

| Position | Terminls brdged-first contact plate | Terminls brdged-second contact plate |
|---|---|---|
| 1 (FIG. 20) | 30–34–40 | None |
| 2 (FIG. 21) | 34–42 | 32–38 |
| 3 (FIG. 22) | 34–42 | None |
| 4 (FIG. 23) | 30–36–42 | None |

As can best be seen in FIGS. 9–12, the switch assembly 16 further includes a four position shaft 102 made of polypropylene. The shaft 102 includes a central axle 104 and a disk-shaped portion 106 extending radially outwardly from the axle near a longitudinal midpoint of the axle. Concentric with and spaced outwardly from the central axle 104 is a cylinder 108 which extends in a rearward direction from a rearward facing surface of the disk-shaped portion 106. Three evenly spaced studs 112 also extend rearward from the disk-shaped portion rearward facing surface. The studs 112 are disposed near an outer periphery of the disk-shaped portion 106 and each is parallel to the central axle 104. The studs 112 interfit in three cylinders 114 which extend in a forward direction from a forward facing surface 116 (FIG. 13) of the first insulator plate 96. The engagement of the studs 112 and the cylinders 114 result in the first and second insulator plates moving in rotational unison with the shaft 102.

Figure 10:
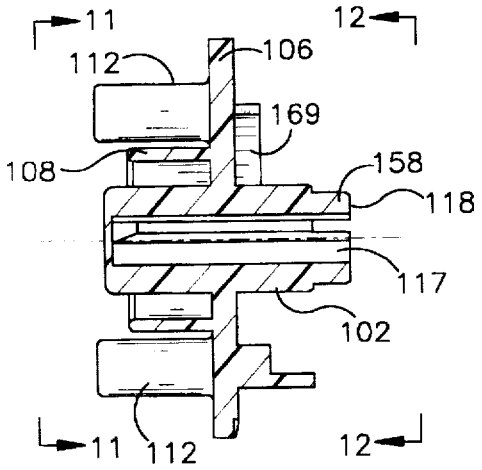
FIG. 10 is a side view, partly in elevation and partly in section, of the shaft of FIG. 9.
Figure 11:
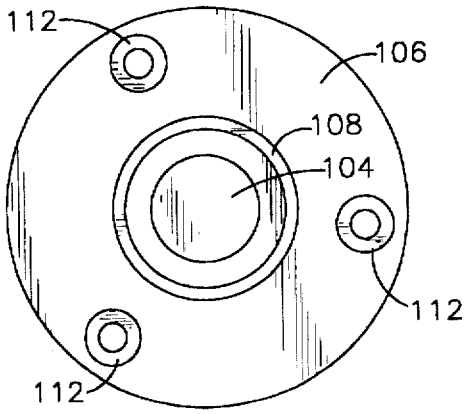
FIG. 11 is a back elevation view of the shaft of FIG. 9 as seen from a plane indicated by the line 11—11 in FIG. 10.

As can be seen in FIG. 10, the shaft central axle 104 includes a slotted opening 117 in a forward facing distal end 118 of the shaft 102. The opening 117 is sized to receive an enlarged distal portion 120 (FIG. 1) of the key 18. Thus, as an operator of the vehicle turns or rotates the key 18, the shaft 102, the first and second insulator plates 96, 100 and the first and second contact plates 90, 92 all rotate in unison with the key. As the key 18 is moved from position to position, the first and second contact plates 90, 92 contact the terminal end s 30*a*, 32*a*, 34*a*, 36*a*, 38*a*, 40*a*, 42*a* to bridge the terminals 30, 32, 34, 36, 38, 40, 42 as discussed above to complete the desired circuits. FIGS. 20–23 illustrate the positions of the first and second contact plates 90, 92 in the switch assembly position 1 (off position, FIG. 20), position 2 (first ran position, FIG. 21), position 3 (second run position, FIG. 22), and position 4 (momentary start position, FIG. 23).

It should be appreciated that the present invention contemplates that different conductor plate configurations and terminal end positions with respect to the cover to permit a multiplicity of the bridging possibilities. Furthermore, the number of switch assembly positions may be changed to more or less than four positions by minor changes in design of the housing 14 and the shaft 102 and such modifications are within the scope of the present invention.

Figure 4:
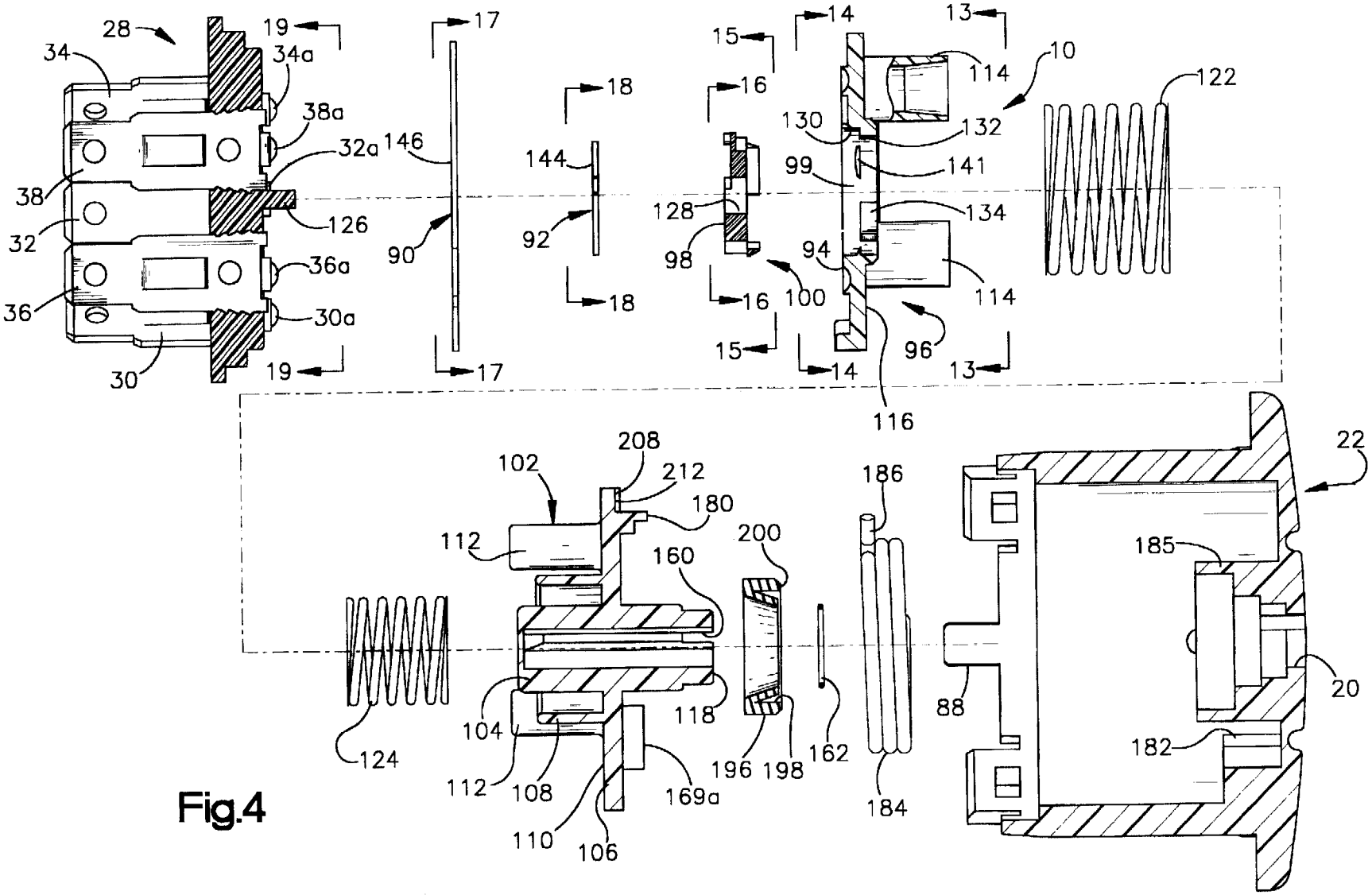
FIG. 4 is an exploded sectional view of the ignition switch of FIG. 1.
Figure 5:
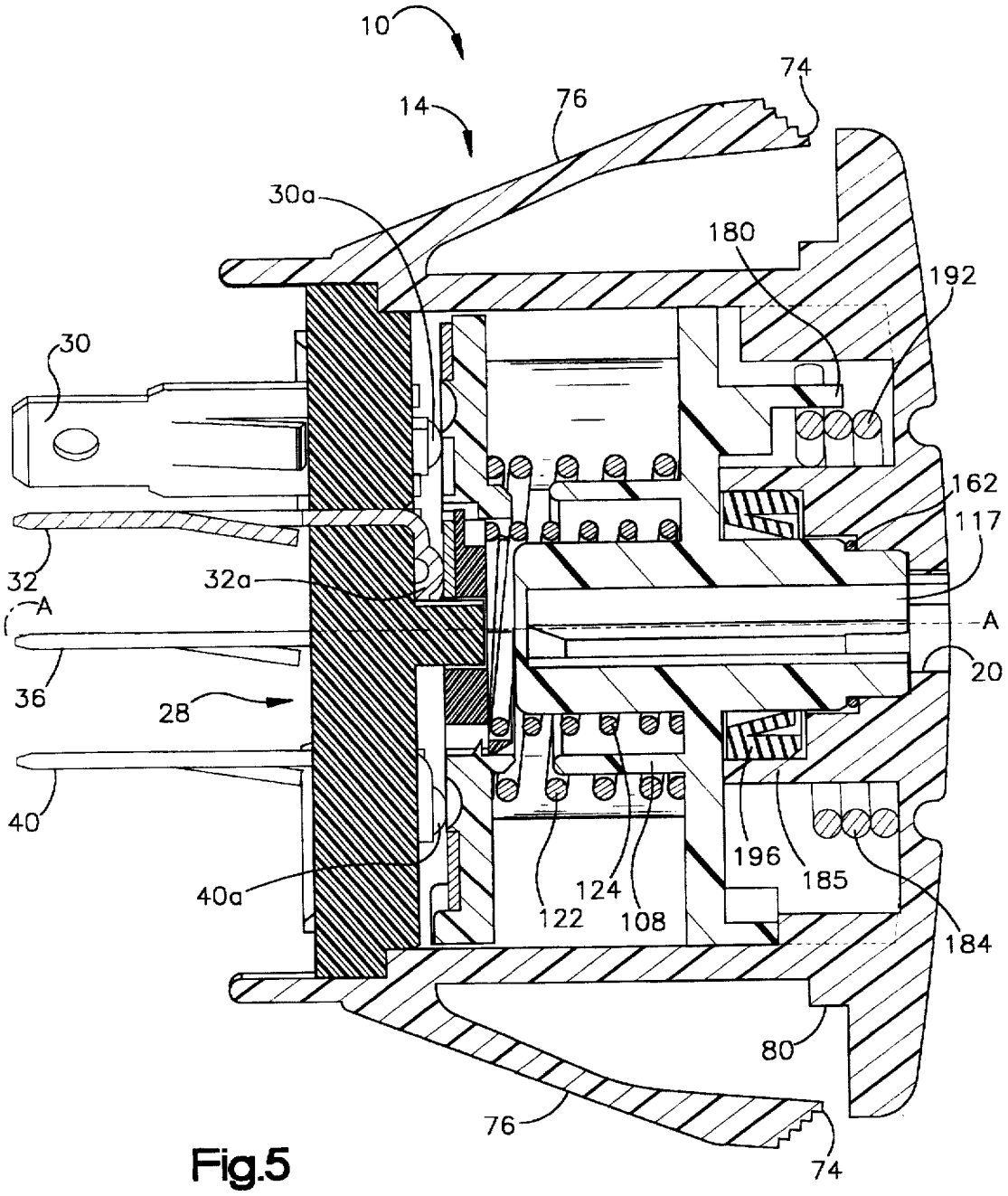
FIG. 5 is a sectional view of the ignition switch of FIG. 1.

As can be seen in FIG. 5, a first compression spring 122 is disposed between the rearward facing surface 110 of the disk-shaped shaft portion 106 and the first insulator plate 96 to bias the first insulator plate and the first contact plate 90 toward the terminal end portions 30*a*, 34*a*, 36*a*, 40*a*, 42*a* to maintain positive electrical contact between the first contact plate and the terminal end portions contacted by the plate in switch assembly positions 1–4. A smaller second compression spring 124 is disposed between the disk-shaped shaft portion rearward facing surface 110 and the second insulator plate 100 to bias the second insulator plate and the second contact plate 92 toward the terminal end portions 32*a* and 38*a* to maintain positive electrical contact between the second contact plate and the operating lights and the accessory set #2 terminal end portions contacted by the plate in switch assembly position 2. The second compression spring 124 is concentric within the first compression spring 122 and is spaced apart from the first spring by the cylinder 108. To aid in proper alignment of the first and second insulator plates 96, 100 with respect to the terminal end portions 30*a*, 32*a*, 34*a*, 36*a*, 38*a*, 40*a*, 42*a*, the back cover 38 includes a forward extending alignment pin 126 (FIG. 4) which extends into a center opening 128 of the second insulator plate 100.

As noted above, the second insulator plate 100 has limited longitudinal movement along the axis A—A and limited pivoting movement with respect to the first insulator plate 96. Thus, the second contact plate 92 being supported on the rearward surface 98 of the second insulator plate 100, similarly, has limited longitudinal movement along the axis A—A and limited pivoting movement with respect to the first contact plate 90 which is supported on the rearward surface 94 of the first insulator plate 96. The second insulator plate 100 is confined within the central opening 99 of the first insulator plate 96. The central opening 99 of the first insulator plate 96 is defined by a cylindrical peripheral surface that extends from the rearward facing surface 94 of the plate to slightly beyond the forward facing surface 116 of the plate (best seen in FIG. 4). As can best be seen in FIGS. 3, 15 and 16, the second insulator plate 100 is generally cylindrical and includes three spaced apart peripheral ridges 130, 131, 132 extending outwardly from a forward facing surface 133 (FIG. 15).

Movement of the second insulator plate 100 in a forward direction with respect to the first insulator plate 96 is limited by the engagement of the peripheral ridges 130, 131, 132 with corresponding steps 134, 135, 136 (FIGS. 3, 13 and 14) extending inwardly into the central opening 99 of the first insulator plate 96. As can best be seen in FIG. 3, the step 135 extends from a forwardmost edge of the cylindrical peripheral surface defining the opening 99 to about one half the distance to a rearwardmost edge of the cylindrical peripheral surface. The other steps 134, 136, although not seen in FIG. 3 are similarly configured and positioned.

As can best be seen in FIGS. 3, 15 and 16, the second insulator plate 100 also includes three inclined peripheral ridges 136, 137, 138 extending below the rearward facing surface 98 of the second insulator plate 100. Movement of the second insulator plate 100 in a rearward direction with respect to the first insulator plate 96 is limited by the engagement of the inclined peripheral ridges 136, 137, 138 with corresponding inclined steps 139, 140, 141 (FIGS. 3, 13 and 14) extending inwardly into the central opening 99 of the first insulator plate 96. As can best be seen in FIG. 3, the inclined steps 139, 140 extend inwardly at about a midpoint between the forwardmost edge and the rearwardmost edge of the cylindrical peripheral surface defining the opening 99. The other inclined step 141, although not seen in FIG. 3 is similarly configured and positioned.

As noted before, the total longitudinal movement of the second insulator plate 100 (and second contact plate 92) with respect to the first insulator plate 96 (and first contact plate 90) is approximately 0.020 inch. In a forwardmost position of the second insulator plate 100, a terminal end contacting surface 144 of the second contact plate 92 is substantially level with a terminal end contacting surface 146 of the first contact plate 90. During assembly of the switch 10, the second insulator plate 100 is pushed into the first insulator plate central opening 99 from the rearward side of the first insulator plate 96. The inclined peripheral ridges 136, 137, 138 of the second insulator plate 100 deflect inwardly as they pass over the inclined steps 139, 140, 141 of the first insulator plate 96. As the ridges 136, 137, 138 pass over the steps 139, 140, 141, the ridges spring outwardly to their undeflected position.

An inwardly stepped portion 148 (FIG. 14) rearward of the step 136 of the inner peripheral surface of the first insulator plate 96 slidingly interfits in an opening 149 (FIGS. 15 and 16) in the outer peripheral surface of the second insulator plate 100 prevent the second insulator plate from rotating with respect to the first insulator plate 96. As noted above, the second contact plate 92 is disposed in a recessed portion of the rearward facing surface 98 of the second insulator plate 100 and thus is constrained from moving with respect to the plate. A tongue portion 152 (FIG. 16) of the second insulator plate rearward facing surface 98 interfits with a corresponding slot 154 (FIG. 18) in the second contact plate 92 to insure proper orientation and alignment of the conductor plate 92 on the rearward facing surface of the insulator plate 100.

The rearward facing surface 94 of the first insulator plate 96 includes two raised arcuate peripheral portions 156 which interfit with peripheral slots 157, 158 (FIG. 17) of the first contact plate 90 to insure proper alignment of the first contact plate 90 and the insulator plate and to prevent relative rotation between the two.

A forward facing distal portion 158 (FIG. 9) of the central axle 104 which includes the key receiving slot 117, is of reduced diameter compared to the remainder of the axle. A snap ring 162 is positioned adjacent the step between the reduced diameter distal portion 158 and the remainder of the axle. The snap ring 162 spreads slightly when the wider distal portion 120 of the key 18 is inserted through the bezel opening 20 and into the key receiving slot 117. When the key 18 is filly inserted, the snap ring 162 holds against a back edge 166 (FIG. 1) of the key distal portion to prevent the key from failing out of the ignition switch 10 during operation of the vehicle.

Figure 9:
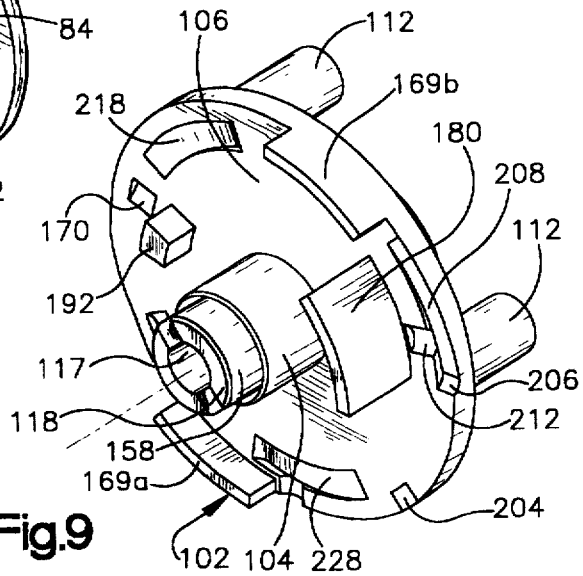
FIG. 9 is a perspective view of a shaft of a switch assembly of the ignition switch of FIG. 1.
Figure 12:
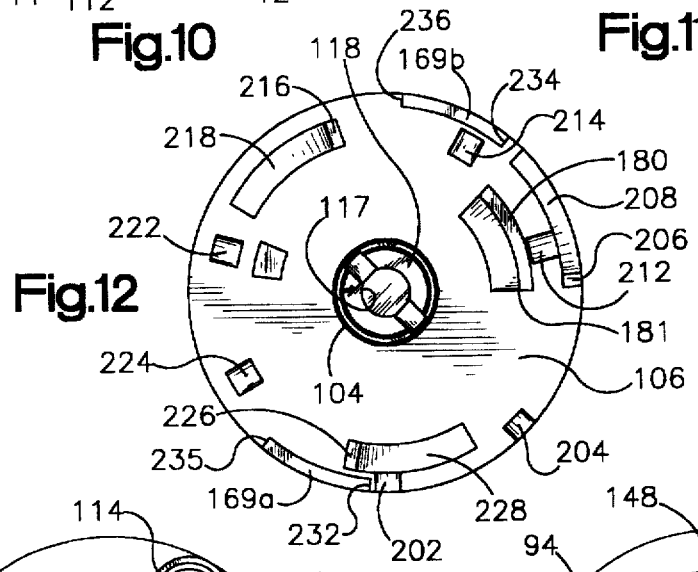
FIG. 12 is a front elevation view of the shaft of FIG. 10 as seen from a plane indicated by the line 12—12 in FIG. 10.

As can be seen in FIGS. 9 and 12, a forward facing side of the disk-shaped portion 106 of the shaft 102 includes three sets of detents. The three sets of detents cooperate with three raised arcuate nub portions extending from a rearward facing side of the housing interior region to provide position indicating stopping points at switch assembly positions 1, 2 and 3. The stopping points provide a tactile indication to the operator turning the key 18 that the switch assembly 16 is at position 1, 2 or 3 or the momentary start position 4. Each set of detents comprises three detents and an arcuate ramped recess extending from the third detent. The detents and the ramped recess of a given set are aligned along an arc formed by a radius extending from a center of the shaft disk shaped portion 106.

As can best be seen in FIG. 12, an outermost set of detents comprises detents 202, 204, 206 and a ramped recess 208 which are formed in the forward facing side of the disk-shaped portion 106. The ramped recess 208 extends counterclockwise in FIG. 12 from the detent 206 and ramps upward from a depth of the detent 206 to a generally planar surface of the forward facing side of the disk-shaped portion 106. The second and third sets of detents are aligned along a common arc and are positioned radially inwardly of the outermost set of detents. The second set of detents comprises detents 212, 214, 216 and a ramped recess 218. The ramped recess 218 extends counterclockwise in FIG. 12 from the detent 216 and ramps upward from a depth of the detent 216 to the generally planar surface of the forward facing side of the disk- shaped portion 106. Finally, the third set of detents comprises detents 222, 224, 226 and a ramped recess 228. The ramped recess 228 extends counterclockwise in FIG. 12 from the detent 226 and ramps upward from a depth of the detent 226 to the generally planar surface of the forward facing side of the disk-shaped portion 106.

Figure 8:
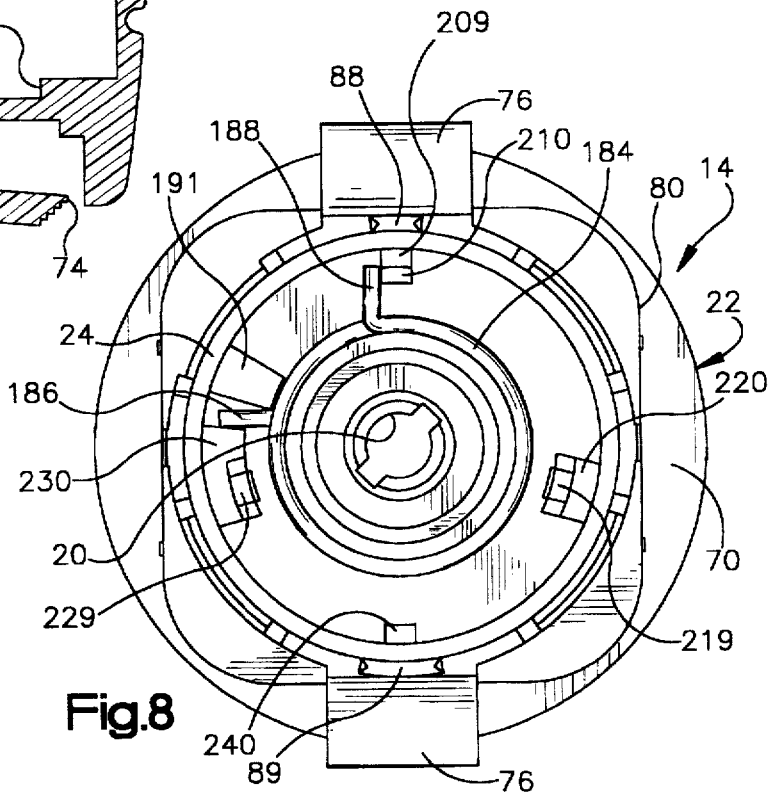
FIG. 8 is a back elevation view of the housing of FIG. 6 as seen from a plane indicated by the line 8—8 in FIG. 7.

Cooperating with the first or outermost set of detents is arcuate raised portion 209 (FIG. 8) which extends rearward from an arm 210. The arm 210 extends rearward from the back side 70 of the bezel 22 along an inner surface of the housing cylindrical portion 24. In position 1 of the switch assembly 16, the raised portion 209 is seated in the shaft detent 202. As the key 22 is rotated clockwise in FIG. 1, the switch assembly 16 correspondingly rotates within the housing 14 such that in position 2, the raised portion 209 is seated in detent 204 and in position 3, the raised portion 209 is seated in detent 206. As the key 22 is turned from position 3 to position 4 (momentary start), the ramped recess 208 rides over the raised portion 209 from the detent 206 to an end of the recess 208. As will be explained below, a return spring 184 (FIG. 8) disposed between the shaft disk-shaped portion 106 and the housing bezel back side 70 is compressed as the switch assembly 16 rotates from position 3 to position 4 and functions to return the switch assembly 16 to position 3 when the operator releases the key at position 4 or sufficiently reduces clockwise torque applied to the key 22.

Cooperating with the second set of detents is arcuate raised portion 219 (FIG. 8) which extends rearward from an arm 220 and is spaced from the inner surface of S the housing cylindrical portion 24. The arm 220 extends rearward from the bezel back side 70 along the inner surface of the housing cylindrical portion 24. In position 1 of the switch assembly 16, the raised portion 219 is seated in detent 212. As the key 22 is rotated clockwise in FIG. 1, the switch assembly 16 correspondingly rotates in the housing such that in position 2, the raised portion 219 is seated in detent 214 and in position 3, the raised portion 219 is seated in detent 216. As the key 22 is turned from position 3 to position 4, the ramped recess 218 rides over the raised portion 219 from the detent 216 to an end of the recess 218.

Cooperating with the third set of detents is arcuate raised portion 229 (FIG. 8) which extends rearward from an arm 230 and is spaced from the inner surface of the housing cylindrical portion 24. The arm 230 extends reward from the bezel back side 70 along the inner surface of the housing portion 24. In position 1 of the switch assembly 16, the raised portion 229 is seated in detent 222. As the key 22 is rotated clockwise in FIG. 1, the switch assembly 16 correspondingly rotates in the housing such that in position 2, the raised portion 229 is seated in detent 224 and in position 3, the raised portion 229 is seated in detent 226. As the key 22 is turned from position 3 to position 4, the ramped recess 228 rides over the raised portion 229 from the detent 226 to an end of the recess 228.

The switch assembly 16 is prevented from rotating clockwise past position 4 by the cooperation of two forward facing raised peripheral portions **169*a*, 169*b* of the shaft disk-shaped portion 106 and the arm 210 and another rearward extending arm 240 (FIG. 8) of the housing 14. The arm 240 extends rearward from the bezel back side 70 along the inner surface of the housing cylindrical wall portion 24. When the switch assembly 16 is turned to position 4, an edge 234 of the peripheral portion 169*b* contacts the arm 240 and an edge 235 of the peripheral portion 169*a* contacts the arm 210 to prevent further clockwise rotation of the switch assembly. The switch assembly 16 is prevented from rotating counterclockwise past position 1 by the cooperation of forward raised peripheral portion 169*a* of the shaft disk-shaped portion 106 and the arms 210, 240 of the housing. When the switch assembly 16 is turned to position 1, an edge 232 of the peripheral portion 169*a* contacts the arm 210 and an edge 236 of the peripheral portion 169*b* contacts the arm 240** to prevent further counterclockwise rotation.

The return spring 184 causes the switch assembly 16 to return from position 4 to position 3 when the key 22 is released at position 4. The return spring 184 is a coiled spring disposed in the housing interior region around a cylinder 185 extending in a rearward direction from the housing bezel back side 70 into the housing interior region and includes straight end portions 186, 188. The end portion 186 is secured between the arm 230 and an arm 191 extending rearwardly from the bezel back side 70. The return spring end portion 188 abuts the arm 210 extending in a rearward direction from the housing bezel back side 70. A stop 180 extends forward from the forward facing side of the shaft disk shaped portion 106. When the switch assembly 16 is inserted into the housing 14 and the switch assembly is turned to position 3, an edge 181 of the stop 180 abuts the return spring end portion 188 just inwardly of the arm 210. As the key 22 is turned beyond position 3 toward position 4, the stop 180 rotates the return spring end portion 188 toward arm 191 (counterclockwise as viewed in FIG. 8). The return spring 184 is increasingly compressed as the switch assembly 16 moves from position 3 to position 4 and thus biases the switch assembly to return to position 3. Interference between the stop 180 and the arm 191 prevent the key 18 and the switch assembly 16 from being rotated beyond position 4.

The cylinder 185 includes an inwardly stepped portion 194 which provides a seat for a seal 196. The seal 196 is cylindrical includes a V-shaped groove 198 in a forward facing edge of the seal. The inner diameter is sized to sealing overlie a portion of the axle 104 just rearward of the reduced diameter axle distal portion 158. Should liquid enter the bezel opening 20 around the key 18, the pressure of the liquid on the seal 196 will cause liquid to enter a distal opening 200 of the V-shaped groove of the groove 198 to widen. As the groove 198 opening widens, the strength of the seal between the seal 196 and the axle 104 and the seal and the cylinder increases thus preventing the liquid from entering into a portion of the housing interior region where the terminal ends and contact plates are disposed.

The present invention has been described with a degree of particularity, but it is the intent that the invention include all modifications from the disclosed preferred design failing within the spirit or scope of the appended claims.

We claim:

1. An ignition switch comprising:

a) a housing defining an interior region;

b) a cover affixed to a back end of the housing and supporting a plurality of electrical terminals, each terminal having an end portion extending into the housing interior region;

c) a switch assembly supported by the housing and at least partially disposed within the interior region, the switch assembly rotatable about an axis of rotation between at least two positions, the switch assembly having a first and a second conductive contact plate, the second contact plate movable with respect to the first contact plate along the switch assembly axis of rotation; and d) in at least one of the switch assembly positions, the first contact plate bridging ends of the two terminals and the second contact plate bridging ends of two terminals different than the two terminals bridged by the first contact plate.

2. The ignition switch of claim 1 wherein the first and second contact plates are supported in respective surfaces recesses of first and second insulator plates.

3. The ignition switch of claim 2 wherein the second insulator plate is moveable within an opening of the first insulator plate in a direction along the axis of rotation of the switch assembly.

4. The ignition switch of claim 3 wherein the first insulator plate is coupled to a rotatable shaft of the switch assembly, the shaft having a key accepting slot accessible through an opening in a front side of the housing.

5. The ignition switch of claim 4 wherein the housing front face defines a bezel and the housing futher includes outwardly extending wings extending from the back end of the housing toward the bezel, the bezel and wings coacting to secure the switch to a panel, the panel having an opening sized to accept a rectangular shaped section of the housing disposed between the bezel and an end portion of the wings extending away from the back end of the housing.

6. The ignition switch of claim 5 wherein a first compression spring is disposed between the first insulator plate and a disk shaped portion of the shaft to bias the first contact plate against the terminal ends.

7. The ignition switch of claim 6 wherein a second compression spring is disposed between the second insulator plate and the disk shaped portion of the shaft to bias the second contact plate against the terminal ends.

8. The ignition switch of claim 1 wherein the switch assembly is rotatable between four positions.

9. The ignition switch of claim 4 wherein the housing includes a cylinder extending into the housing interior region from a back surface of the front side of the housing, the cylinder defining an opening aligned with the opening in the housing front side and into which a distal portion of the shaft extends including the shaft key accepting slot.

10. The ignition switch of claim 9 wherein an end of the cylinder opposite an end extending from the back surface of the housing front side supports a seal which encircles a portion of the shaft to prevent contaminants from entering the housing interior region.

11. The ignition switch of claim 10 wherein the seal has a v-shaped groove facing the back surface of the housing front side.

12. An ignition switch for a vehicle comprising:

a) a switch assembly rotatable along an axis of rotation between a plurality of positions and having a first and a second conductive contact plates, the second contact plate being moveable along the axis of rotation with respect to the first contact plate;

b) a set of terminals supported in a cover positioned with respect to the contact plates such that in at least one switch assembly position, the first contact plate bridges ends of at least two terminals of the set of terminals and the second contact plate bridges ends of at least two terminals of the set of terminal, at least two terminals end bridged by the second contact plate being different than the at least two terminals ends bridged by the first contact plate; and c) biasing structure for biasing the first and second contact plates against the terminal ends.

13. The ignition switch of claim 12 further including a housing defining an interior region in which the switch assembly is rotatably supported, the housing having an open back end to which the cover is affixed.

14. The ignition switch of claim 13 wherein the housing further includes a bezel at an end of the housing opposite the back end, the bezel extending radially outwardly beyond a main body of the housing.

15. The ignition switch of claim 14 wherein outwardly extending wings extend forwardly from near the back end of the housing toward the bezel, the housing adapted to be secured in an opening in a panel with a back side of the bezel abutting one face of the panel and distal ends of the wings abutting an opposite face of the panel.

16. The ignition switch of claim 14 wherein the switch assembly further includes a shaft and first and second insulator plates coupled to the shaft, the first insulator plate supporting the first contact plate and the second insulator plate supporting the second contact plate, the shaft including a key accepting slot accessible through an opening in the bezel.

17. The ignition switch of claim 16 wherein the first contact plate is supported in a surface recess of the first insulator plate.

18. The ignition switch of claim 17 wherein the second ignition plate is supported in a surface recess of the second insulator plate.

19. The ignition switch of claim 16 wherein the biasing structure includes first and a second springs, the first spring disposed between an outwardly extending portion of the shaft and the first insulator plate and the second spring disposed between the outwardly extending portion of the shaft and the second insulator plate.

20. The ignition switch of claim 12 wherein the switch assembly is rotatable between four positions.

21. The ignition switch of claim 16 wherein the housing includes a cylinder extending into the housing interior region from a back surface of the front side of the housing, the cylinder defining an opening aligned with the opening in the housing bezel and into which a distal portion of the shaft extends including the shaft key accepting slot.

22. The ignition switch of claim 21 wherein an end of the cylinder opposite an end extending from the back surface of the housing bezel supports a seal which encircles a portion of the shaft to prevent contaminants from entering the housing interior region.

23. The ignition switch of claim 22 wherein the seal has a v-shaped groove facing the back surface of the housing front side.

* * * * *